United States Patent [19]

Heiniger et al.

[11] Patent Number: 4,642,025

[45] Date of Patent: Feb. 10, 1987

[54] VALVE FOR STEAM SUPPLY ON DOUBLE CASING TURBINES

[75] Inventors: Peter Heiniger, Turgi; Jaroslav Masek, Wettingen, both of Switzerland; Herbert Senn, Waldshut-Tiengen, Fed. Rep. of Germany

[73] Assignee: BBC Brown, Boveri & Company, Limited, Baden, Switzerland

[21] Appl. No.: 613,036

[22] Filed: May 22, 1984

[30] Foreign Application Priority Data

Jun. 9, 1983 [CH] Switzerland ..... 3164/83

[51] Int. Cl.[4] ..... F01D 17/14

[52] U.S. Cl. ..... 415/139; 415/151; 415/202

[58] Field of Search ..... 415/134, 139, 151, 153, 415/155, 219 R, 202

[56] References Cited

U.S. PATENT DOCUMENTS 2,527,446 10/1950 Jenks, Jr. et al. ..... 415/139
2,794,616 6/1957 Bernasconi ..... 415/151
2,905,434 9/1959 Hertl ..... 415/202 X
3,190,612 6/1965 Conrad, Jr. et al. ..... 415/134

FOREIGN PATENT DOCUMENTS 2345636 4/1975 Fed. Rep. of Germany ..... 415/202
837975 6/1960 United Kingdom ..... 415/202

*Primary Examiner*—Robert E. Garrett
*Assistant Examiner*—Joseph M. Pitko
*Attorney, Agent, or Firm*—Burns, Doane, Swecker & Mathis

[57] ABSTRACT

The valve intended for direct connection to the outer casing of a double casing steam turbine has a diffusor located in the valve housing, which diffusor protrudes through the outer casing into a connection stub pipe of the inner casing, where it is connected with a flexible seal to the inner casing. In a preferred embodiment, the diffusor sits with a cylindrical step in a corresponding bore of the valve housing, the valve housing consisting of ferritic cast material and the diffusor of austenitic steel, whose coefficient of thermal expansion is greater than that of the valve housing material. The diffusor, which sits loosely in the cold condition, expands more than the valve housing when the turbine becomes hot so that the diffusor is then firmly held in the valve housing.

5 Claims, 4 Drawing Figures

VALVE FOR STEAM SUPPLY ON DOUBLE CASING TURBINES

The present invention relates to valves for supplying steam to double casing turbines.

BACKGROUND OF THE INVENTION

The quick-closing and control valves used in steam turbines are usually located outside and separate from the turbine casing and are connected to the latter by pipe bends entering the casing at right angles. The pipe bends are shaped so that they permit elastic deformations to compensate for the thermal expansions without high thermal stresses appearing in the process. In this arrangement, the pipe bends extend far upwardly from the turbine casing with a corresponding space requirement in the hall, so that such large vertical pipe bends involve large hall heights with corresponding additional costs as compared to a lower power station hall. The pipe bends themselves, however, are also expensive and present substantial sealing problems in the region of the flange connections because of the high steam pressures. In order to avoid these problems, control valves in the vertical position have been flanged directly on the upper part of the turbine casing or welded to their casing block. The disadvantage of the large installation height, however, remains.

In order to avoid this disadvantage, control valves are similarly flanged or welded directly in a horizontal position on the upper part of the casing, but exclusively in the case of single casing turbines. Up to now, however, this could only be practised with single casing turbines because only in these turbines can the valve or valves be raised upwards, alone or together with the casing, in the case of inspections.

In the case of double casing turbines, in which only the exhaust steam pressure is present in the intermediate space bounded by an inner casing shell and an outer casing shell, the outer casing being consequently relieved of the high pressure of the working steam, the control valves were either fastened directly to the outer casing in a vertical position and connected flexibly and so as to seal with the inner casing, or the valves were connected to the inner casing via a pipe entering at right angles into the inner casing, which pipe was flanged to the outer casing. This arrangement does not, therefore, permit the raising of the casing upper part during inspections without the supply pipes and the associated fastening devices also having to be removed.

For a relatively long time, therefore, there has been a requirement for a valve design which, while avoiding the supply pipes mentioned between the valve and the turbine casing upper part, can be attached directly to the latter in a horizontal position and makes it possible to raise the turbine casing upper part without further complication after the removal of the valve.

SUMMARY OF THE INVENTION

It is an object of the present invention, to avoid the particular disadvantage in the case of double casing turbines wherein the previously used valves (allowing for their removal) can only be installed using intermediate pipe bends entering vertically from above into the turbine casing upper part, which, as mentioned, involves larger and therefore more expensive hall heights. This object is accomplished in accordance with the invention by providing a horizontal steam supply with a valve assembly having a diffuser in the form of a tubular body that extends between the inner and outer casing. The body is mounted to compensate for thermal expansion of the diffuser. The diffuser is removable upon axial movement, thereby allowing the outer cover to be removed without interference. By means of the horizontal location of the control valves, in the upper part of the turbine casing, in accordance with the invention the assembly and dismantling work is facilitated and hence the inspection work is also made cheaper.

DETAILED DESCRIPTION OF THE DRAWINGS

Preferred embodiments of the invention are illustrated in the accompanying drawings wherein.

DETAILED DESCRIPTION OF PREFERRED EMBODIMENTS

Figure 1:
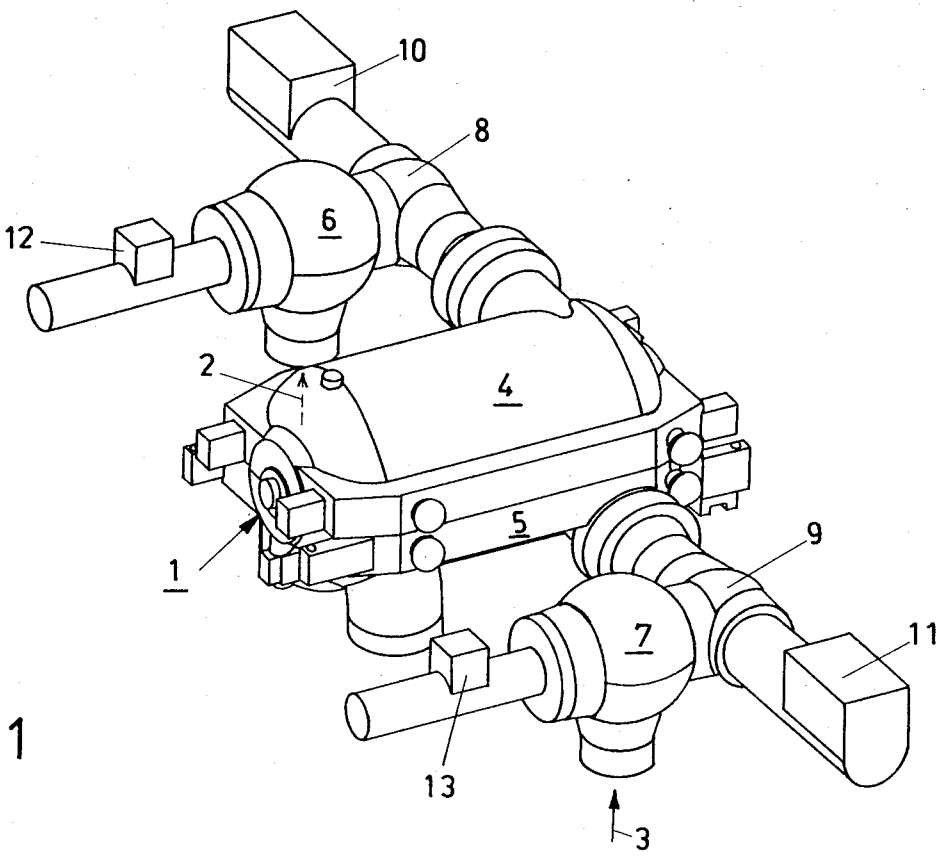
FIG. 1 is a perspective overall view of the high-pressure part of a steam turbine installation in accordance with a first embodiment of this invention with one pair each of quick-closing and control valves.

In FIG. 1, 1 indicates a double casing high-pressure part of a steam turbine installation has a steam supply indicated by the arrows 2 and 3 into the outer casing upper part 4 and into the outer casing lower part 5, respectively. The steam supplied from the boiler enters at 2 and 3 into quick-closing valves 6 and 7, respectively and, when the valves 6 and 7 are open, arrives in the control valves 8 and 9, by means of which the steam flow to the turbine necessary at any particular time can be adjusted and controlled. The adjustment and control of the control valves take place by means of actuator motors 10 and 11, which are built in with the control valves. The quick-closing valves 6 and 7 are actuated by actuator motors 12 and 13, one of whose duties consists of abruptly shutting off the steam supply in the case of a catastrophe.

Figure 2:
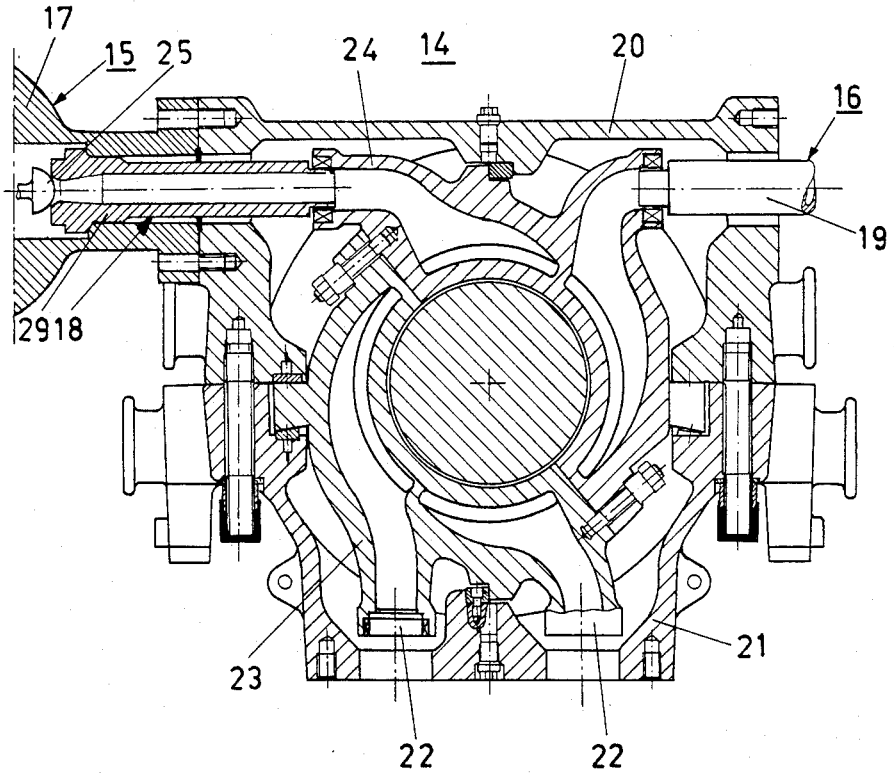
FIG. 2 is a cross-sectional view of a double casing high-pressure part of a steam turbine in accordance with a second embodiment of this invention with two directly flanged control valves provided in the casing upper part.

FIG. 2 shows a vertical cross-section through the inlet volute of a steam turbine 14, the section plane being placed vertically through the axes of two control valves 15 and 16 screwed onto the outer casing upper part 20, of which control valves only a part of the valve housing 17 and the diffusor 18 is shown on the left-hand side and, in contrast, only a part of the diffusor 19 is shown on the right-hand side. In this embodiment of the invention in which the turbine with a quadruple volute inlet, two of the control valves, namely 15 and 16, are fastened at the same height on the outer casing upper part 20 whereas, in the case of the turbine in the embodiment of FIG. 1, one valve each is provided on the outer casing upper part 4 and the outer casing lower part 5. Associated with the two further inlets in the design in accordance with FIG. 2, fastening positions are provided on the outer casing lower part 21 for mounting two steam supply pipes, not shown, which connect two control valves to the connection stub pipes 22 on the inner casing lower part 23.

The horizontally installed control valve 15, shown at the top eft, also represents a part of the valve closing body 25, which acts together with the valve seat on the diffusor 18.

Figure 3:
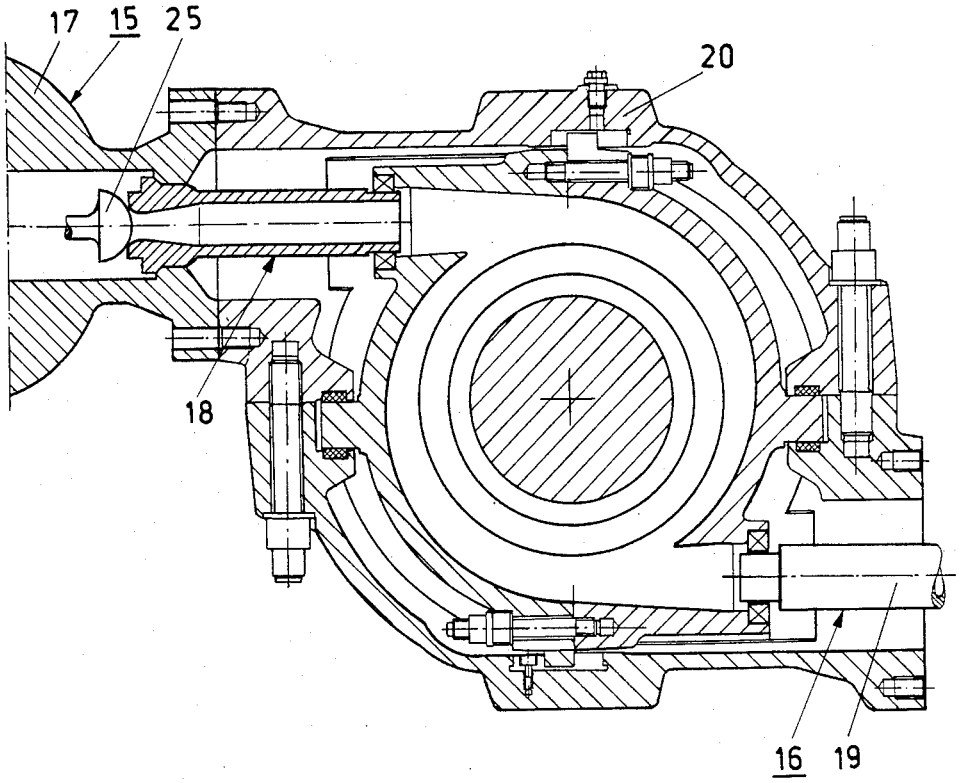
FIG. 3 is a cross-sectional view of a double casing high-pressure part of a steam turbine as in FIG. 1 with one control valve each in the upper and lower casing parts.
Figure 4:
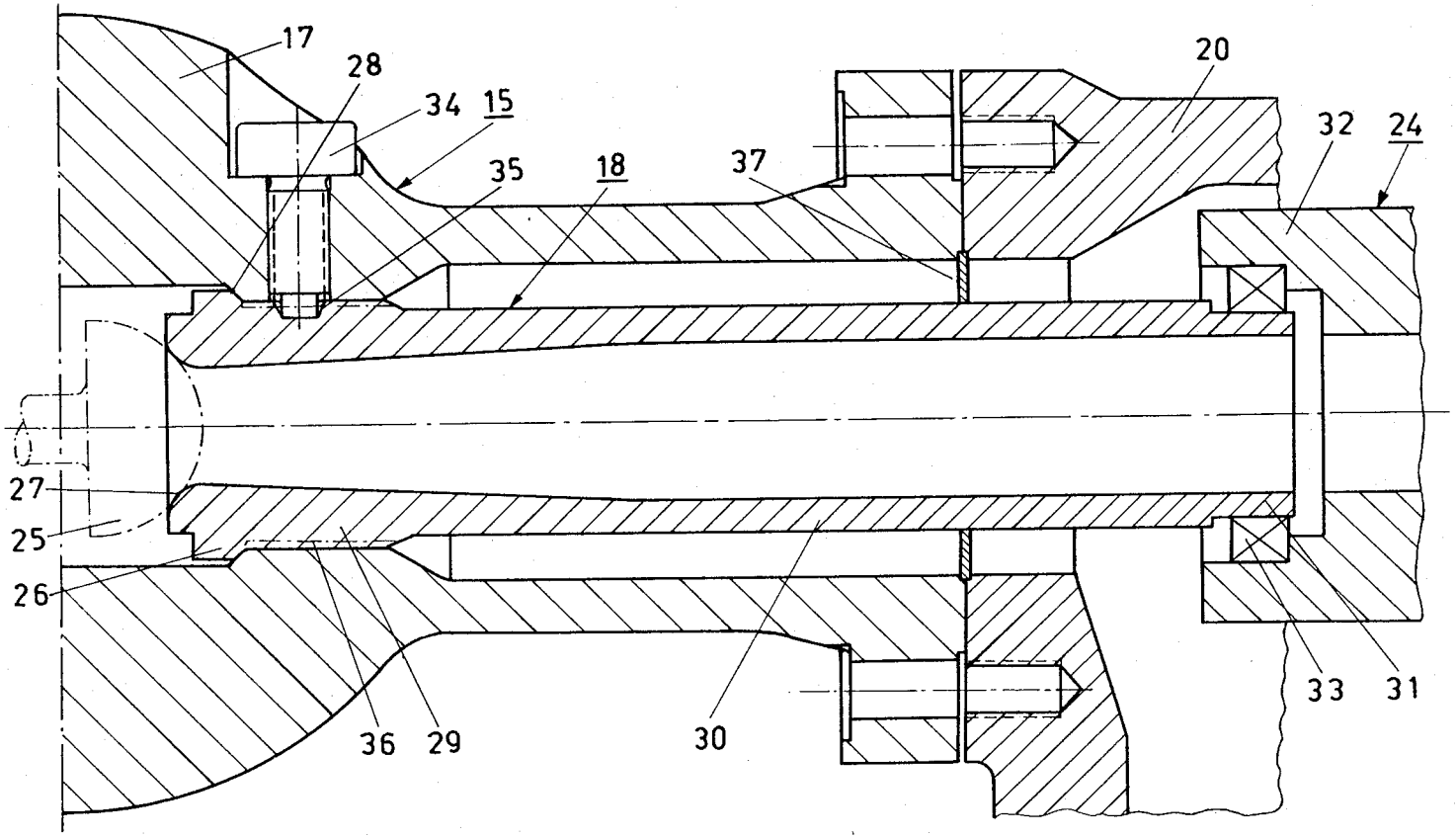
FIG. 4 is a cross-sectional view, on a larger scale, of a diffusor portion of the valve assembly as shown in FIGS. 2 and 3.

FIG. 3 shows a cross-section through a double casing steam turbine in accordance with the embodiment of FIG. 1 with a double inlet and one horizontally installed control valve on each of the outer casing upper and lower parts. The parts analogous to the design in FIG. 2 have the same reference numbers allocated to them in FIG. 3. The precise design of the diffusor 18 and its location relative to the valve housing 17 and the inner casing upper part 24 is apparent from FIG. 4, which shows on a larger scale the installation of the control valve 15 located to the top left in FIG. 2. The full-line contour of the diffusor defines a first embodiment form, in which an annular collar has an outer conical surface 28 in the region of the valve seat 27, which conical surface is in contact with a corresponding inner conical surface in the valve housing 17. In this case, the collar 26 is continued downstream by a cylindrical step 29 which, in the cold condition of the valve, sits with a close clearance fit in a corresponding bore in the valve housing 17. This cylindrical step 29 is continued downstream by a long diffusor part 30, which is cylindrical on the outside and ends at the inner end in a guide spigot 31 of smaller diameter. This is guided, so as to be longitudinally and laterally displaceable, within a connection stub pipe 32 of the inner casing upper part 24 of the turbine in a diagrammatically represented piston ring seal 33 of known type, so that unimpeded thermal expansion is possible.

A securing screw 34 is provided in the housing 17 in the region of the cylindrical step 29 of the diffusor, which securing screw engages with axial clearance in a hole 35 in the cylindrical step 29 and prevents displacement of the diffusor 18 in the cold condition of the turbine, when the diffusor is not firmly held in the valve housing. In order that the diffusor 18 may be held absolutely firmly and steam-tight in the valve housing 17 during operation of the turbine, the valve housing 17 consists of ferritic cast material and the diffusor 18, in contrast, of austenitic steel, whose coefficient of thermal expansion is greater than that of the ferritic cast material, so that the diffusor is clamped in the valve housing when the turbine is hot because of the close fit of the diffusor in the valve housing. When the turbine has cooled, the diffusor becomes loose again in the valve housing so that it can be withdrawn without difficulty during dismantling of the valve.

In a second embodiment form, the cylindrical step 29 installed almost without clearance in the valve housing is replaced by a cylindrical step 36 with a larger clearance relative to the bore in the valve housing, the contour of which step being indicated by a dash-dotted line. The contact shoulder can then be designed conically in a similar manner to the embodiment first mentioned but also as a plane annular contact surface.

This arrangement, in conjunction with the spherically designed valve closing body 25, which is movably connected to the valve spindle, not shown, ensures that the diffusor—during relative movements between the outer and inner upper parts 20 and 24 caused by differential thermal expansions—can adjust itself without stress, i.e. without deformation, to the particular position of the connection stub pipe 32 relative to the valve housing 17. The pin end of the securing screw must similarly, in this embodiment, engage with clearance along the longitudinal axis of the pin in the corresponding hole in the cylindrical step 36 so that the adjustment movement of the diffusor is not impeded.

A support ring 37 surrounding the diffusor 18 with small clearance can be provided, especially where long diffusors are used, in the sealing joint between the outer casing upper part 20 and the valve housing 17. This support ring is clamped at its periphery in the sealing joint and can also serve as a guide for the insertion of the diffusor into the turbine during assembly.

Using this design of valve, it is possible to carry out assembly and dismantling without having to remove the pipes leading from the valves into the turbine. With horizontal installation of valves of the known types, it is not possible—because of the diffusor projecting into the outer casing—to remove them from the casing without also having to dismantle the pipes leading to the valve. The diffusor cannot, in fact, be withdrawn with the valve installed so that the valve must be pushed out of the turbine by a distance which is at least equal to the length of the part of the diffusor which projects into the turbine. Since this, as mentioned, is only possible, however, after dismantling the pipe in front of the valve, the horizontal installation of such valves in double casing turbines prior to this invention was impossible due to the associated difficulties.

In a valve in accordance with the present invention, on the other hand, the diffusor can be withdrawn after dismantling the actuator motor visible in FIG. 1 and the valve inserts and after loosening the securing screw 34, whereupon the turbine casing upper part can be removed for inspection purposes.

While this invention has been illustrated and described in accordance with certain preferred embodiments, it is recognized that variations and changes may be made therein, without departing from the invention as defined by the claims.

What is claimed is:

1. In a horizontal steam supply for double casing turbines, of the type having a valve housing communicating with exhaust steam pressure and an inner housing communicatable with fresh steam pressure, the valve housing accepting a diffusor, a valve seat, a cooperating valve closing body and a flange junction for direct fastening on an outer housing of a double casing turbine and also having an actuator motor and elements for transmitting the actuator motor movement to the valve closing body, the improvement comprising an outer casing of the double casing turbine and an inner casing of the double casing turbine; said inner casing enclosed by said outer casing; said diffusor positioned in the valve housing, the outer casing and the inner casing and concentric with at least a portion of the valve housing, the outer casing and the inner casing; a plain flange sealing surface provided on the valve housing for connection with the outer casing, the connection between the valve housing and the outer housing defining a junction arrangement; the position of the diffusor extending sufficiently beyond the flange sealing surface of the valve housing that a movable seal is provided between the inner casing and the diffusor at a position axially spaced from the plain flange sealing surface in a direction toward the turbine; a fastening device provided in the valve housing at a position axially spaced from the plain flange sealing surface in a direction away from the turbine, the fastening device being directly accessible and protruding through the valve housing to adjustably secure the diffusor and permit adjustment of the position of the diffusor so as to compensate for heat; said junction arrangement permitting the valve housing to be moved in a direction perpendicular with respect to the plain flange sealing surface of the outer casing.

2. The apparatus in accordance with claim 1 wherein the convex contact surface of the collar is an external conical surface, and the valve housing is formed of ferritic cast material and the diffusor is formed of austenitic steel whose coefficient of thermal expansion is greater than that of the ferritic cast material, said cylindrical step is seated with a close clearance fit in the corresponding bore in the valve housing whereby when the turbine is hot, the diffusor expands more than the valve housing and the diffusor consequently becomes firmly held in the valve housing.

3. The apparatus in accordance with claim 1, wherein the convex contact surface of the collar is an external spherical surface and the cylindrical step is seated with a large clearance in the corresponding bore of the valve housing whereby the diffusor can follow relative movements between the outer casing and the inner casing of the turbine.

4. The apparatus in accordance with claim 1, including a securing screw in the valve housing, which screw engages by means of a cylindrically shaped end in a hole in the cylindrical step in order to prevent axial displacement of the diffusor.

5. The apparatus in accordance with claim 1, including a support ring for the diffusor on the flange sealing surface of the valve housing.

* * * * *